US006571669B2

(12) United States Patent
Benatz et al.

(10) Patent No.: US 6,571,669 B2
(45) Date of Patent: Jun. 3, 2003

(54) SOCKET WRENCH ORGANIZER

(76) Inventors: Robert C. Benatz, 574 Stone Harbor Cir., La Habra, CA (US) 90631; Willard K. Brakman, 23982 Quail Way, Lake Forest, CA (US) 92630; Thomas R. Pettibone, 711 Valencia Mesa Dr., Fullerton, CA (US) 92835

( * ) Notice: Subject to any disclaimer, the term of this patent is extended or adjusted under 35 U.S.C. 154(b) by 0 days.

(21) Appl. No.: 09/968,251

(22) Filed: Oct. 1, 2001

(65) Prior Publication Data

US 2003/0061914 A1 Apr. 3, 2003

(51) Int. Cl.[7] ..... B25B 23/16

(52) U.S. Cl. ..... 81/177.4; 81/900; 206/378; 206/350

(58) Field of Search ..... 81/177.4, 900, 81/490, DIG. 11, 437–439; 206/378, 350, 818

(56) References Cited

U.S. PATENT DOCUMENTS

| | | | | | |
|---|---|---|---|---|---|
| 3,405,377 | A | | 10/1968 | Pierce | |
| 3,822,906 | A | * | 7/1974 | Gaines | 220/324 |
| 4,591,817 | A | | 5/1986 | Miller | |
| 4,802,580 | A | | 2/1989 | Anderson | |
| 5,080,230 | A | * | 1/1992 | Winnard | 206/350 |
| 5,500,631 | A | | 3/1996 | Negus | |
| 5,570,784 | A | * | 11/1996 | Sidabras et al. | 206/378 |
| 5,669,516 | A | * | 9/1997 | Horn | 206/350 |
| 5,725,107 | A | | 3/1998 | Dembicks | |
| 5,782,150 | A | * | 7/1998 | Huang | 206/234 |
| 6,047,824 | A | * | 4/2000 | Winnard | 206/350 |

* cited by examiner

*Primary Examiner*—D. S. Meislin

(57) ABSTRACT

A socket wrench organizer includes top and bottom socket holders with receptacles for holding sockets for a socket wrench. The receptacles may be individually sized to each socket. A magnet is provided near the bottom of each receptacle for securely holding the sockets. Magnetic or mechanical fasteners hold the socket wrench organizer together in a closed position with the sockets inside for even more securely holding the sockets. The sockets are nested within each other when the socket wrench organizer is in the closed position for compactness and space efficiency. A wrench handle is provided with a flat portion and a hole to facilitate attachment in a convenient package of the socket wrench and socket wrench organizer in the closed position. A non-scratching, non-marring coating is provided on the surface of the socket wrench organizer to facilitate magnetically attaching or merely placing the socket wrench organizer on a scratchable surface.

21 Claims, 3 Drawing Sheets

SOCKET WRENCH ORGANIZER

BACKGROUND OF THE INVENTION

1. Field of the Invention

The present invention generally relates to tool storage and organizing. More specifically, the invention relates to an organizer for keeping sockets in proximity with their associated socket wrench and which may be conveniently and temporarily mounted on any magnetically attractable surface.

2. Related Art

The socket wrench is a common, familiar, and widely used tool. It is used in such widely varied applications as, for example, auto mechanics and electronics work. The socket wrench usually includes a handle unit with a head for attaching interchangeable sockets of various sizes. The head typically includes a drive nub which is square for fitting into a square drive hole in the socket. For example, standard sized drive nubs may be ¼, ⅜, or ½ inches square. The drive nub usually includes a spring and ball detent mechanism for more securely holding the interchangeable socket. The head typically includes a ratchet unit, but may include a swiveling hinge or universal joint, or other various features and combinations of features. The relatively expensive wrench is usable with a large number of relatively inexpensive sockets, which are interchangeable and can be supplied in a large range of varying sizes.

It is desirable to have some means of storing the multiplicity of interchangeable sockets in order to keep them together in one place, to keep them from getting lost, to keep them sorted, to make them readily transportable, and to keep them readily accessible. Further, it is desirable to be able to conveniently attach the holder to a project working surface such as an automobile fender, or metal electronics equipment rack. In addition, it is desirable to have some compact, space efficient means to keep the set of interchangeable sockets together with their socket wrench.

One common and inexpensive apparatus used to address some of these problems is a simple socket rack which includes a number of spring clips in a line and typically a carrying handle at one end. Each spring clip is of a size to fit into the drive hole of each socket, and holds the socket by friction against the force of the spring inside the drive hole. These simple socket racks are prone to having the surface of the spring clips wear out so that sockets are not securely held and may come off too easily. In addition, the spring clips can lose resiliency over time, also contributing to the same problem of sockets not being securely held. These simple racks typically place all the sockets out in a single line so that they tend to be long and bulky and hard to fit into the limited space of, for example, a toolbox. In other words, these simple racks are not compact and space efficient.

Another rack, similar to the simple spring clip socket rack, is one which provides a row of socket nubs with a spring and ball detent mechanism, mimicking that of the wrench drive nub, in each socket nub. This rack appears to be an attempt at addressing the problem, outlined above, of securely holding the sockets despite wear, but may still be subject to wear of the ball and nub, and loss of resiliency in the spring of the spring and ball detent mechanism. A disadvantage of this rack is that it is relatively expensive.

Another rack that addresses the problem of securely holding the sockets despite wear is disclosed in U.S. Pat. No. 5,725,107 which uses a cam mechanism to "lock" a socket in place after it has been placed over a nub. This rack stores the sockets spaced apart, due to the bulkiness of the cam mechanism, in a line so that it also is not compact and space efficient.

Magnetic racks address the problem of wear by using magnets to hold the sockets rather than a spring clip or nub. For example, U.S. Pat. No. 4,591,817 discloses a magnetic socket rack on which sockets may be placed in a line. This rack does not provide any aid for positioning or sorting the sockets on the rack. It provides an adhesive backing for attachment of the rack to a work bench or tool box, but not for temporary convenient attachment to a work surface. Another rack which places all the sockets out in a line, but with the improvement of adding a plate to help position the sockets on the rack is disclosed in U.S. Pat. No. 4,802,580. This rack discloses a magnet for temporarily attaching the rack to a metallic work surface, but is not concerned with attaching or placing the rack on a work surface that is easily scratched or marred, such as a painted car fender or plastic surface. Another rack which places all the sockets out in a line, with the improvement of adding a contoured tray to help position the sockets on the rack is disclosed in U.S. Pat. No. 5,500,631, which also discloses providing a magnet for temporarily attaching the rack to a metallic work surface and a coating to increase friction between the work surface and the rack, but not to prevent marring or scratching of the work surface. Another rack which places all the sockets out in a line, with individually sized holes for each socket to help position the sockets on the rack is disclosed in U.S. Pat. No. 3,405,377. None of these magnetic racks protect the sockets while they are being stored from accidentally being dislodged by the user's fingers, for example, or from falling off of or out of the rack if the rack is subjected to a sudden or accidental jarring or impact.

As can be seen, there is a need for a socket wrench organizer which securely holds a number of interchangeable sockets and which continues to securely hold the sockets despite normal wear. There is also a need for a socket wrench organizer which protects the sockets from being accidentally dislodged or removed while the sockets are being stored or carried. There is also a need for a socket wrench organizer which can be conveniently placed on or temporarily attached to a work surface without marring or scratching the work surface. There is a further need for a socket wrench organizer which is compact and space efficient, and which facilitates storing the sockets, for example, in toolboxes or metal toolbox drawers. In addition, there is a need for a socket wrench organizer which facilitates keeping the sockets together with the wrench with which they are to be used.

SUMMARY OF THE INVENTION

The present invention provides a socket wrench organizer which securely holds a number of interchangeable sockets and for which normal wear will not affect how securely the sockets are held. Furthermore, the socket wrench organizer of the present invention protects the sockets from being accidentally dislodged or removed while the sockets are being stored or carried with the socket wrench organizer in its closed position. One embodiment also provides a socket wrench organizer that can be conveniently placed on or temporarily attached to a work surface without marring or scratching the work surface. In one embodiment the socket wrench organizer is compact and space efficient, and facilitates storing sockets, for example, in toolboxes or metal toolbox drawers. In addition, one embodiment provides a socket wrench organizer that facilitates keeping the sockets together with the wrench with which they are to be used.

In one aspect of the present invention, a socket wrench organizer includes top and bottom socket holders with receptacles for holding sockets for a socket wrench. The receptacles may be individually sized to each socket, for example, or a single receptacle, not sized to the individual sockets, may be provided with centering nubs for each socket, or a single receptacle with linearly tapered sides for aligning the sockets may be provided. A magnet is provided near the bottom of each receptacle for securely holding the sockets in the receptacles. Fasteners, for example, magnets, are provided for holding the top and bottom socket holders together in a closed position with the sockets inside for added security in holding the sockets, for example, when being stored or carried.

In another aspect of the present invention, the sockets are nested within each other when the socket wrench organizer is holding sockets in the closed position. The nesting of sockets makes the socket wrench organizer more compact and space efficient, improving, for example, efficiency of storage and ease of carrying the sockets.

In another aspect of the present invention, a wrench handle is provided with a flat portion and a hole or holes to facilitate attachment of the socket wrench and socket wrench organizer in the closed position, improving organization, for example, by keeping the socket wrench together in a convenient package with its associated sockets.

In another aspect of the present invention, the magnets used for securely holding the sockets in the receptacles can also be used for temporarily attaching the socket holders to magnetically attractable work surfaces. A rubberized coating or other non-scratching, non-marring coating is provided on the surface of the socket wrench organizer to facilitate either attaching the socket wrench organizer to a magnetically attractable scratchable surface, such as a car fender, for example, or for merely placing the socket wrench organizer on a scratchable non-magnetic surface such as a plastic electronics cabinet.

DETAILED DESCRIPTION OF THE INVENTION

The present invention is directed to an apparatus for storing, organizing, and accessing sockets for a socket wrench. Although the following description contains specific information pertaining to the implementation of the present invention, the present invention may, nevertheless, be implemented in a manner different from that specifically described here. The drawings in the present application and their accompanying detailed description serve to describe example embodiments of the invention. The described embodiments should be considered as illustrative and not restrictive.

Figure 1:
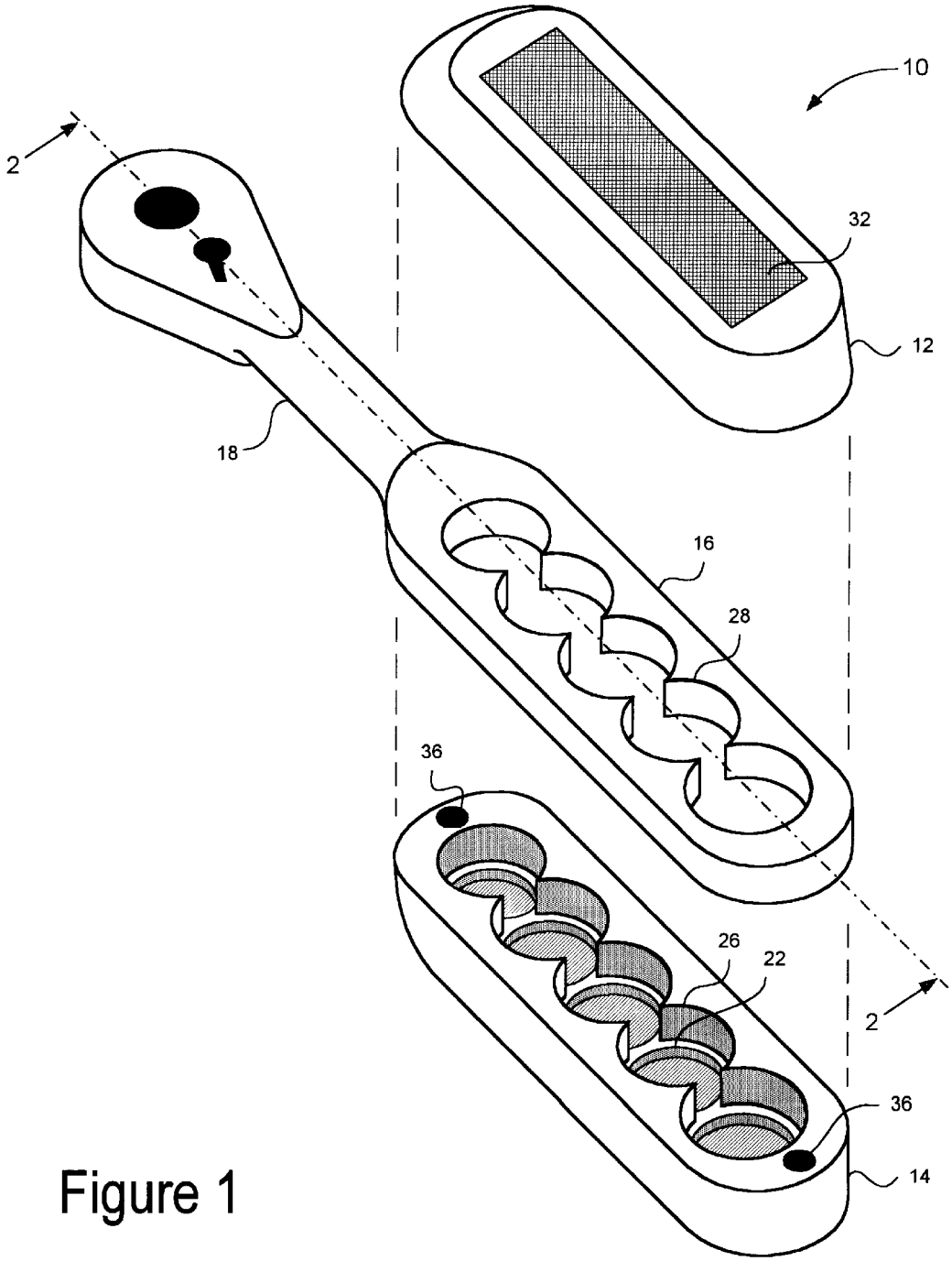
FIG. 1 is a perspective view of a socket wrench organizer in a disassembled state in accordance with one embodiment of the present invention.
Figure 2:
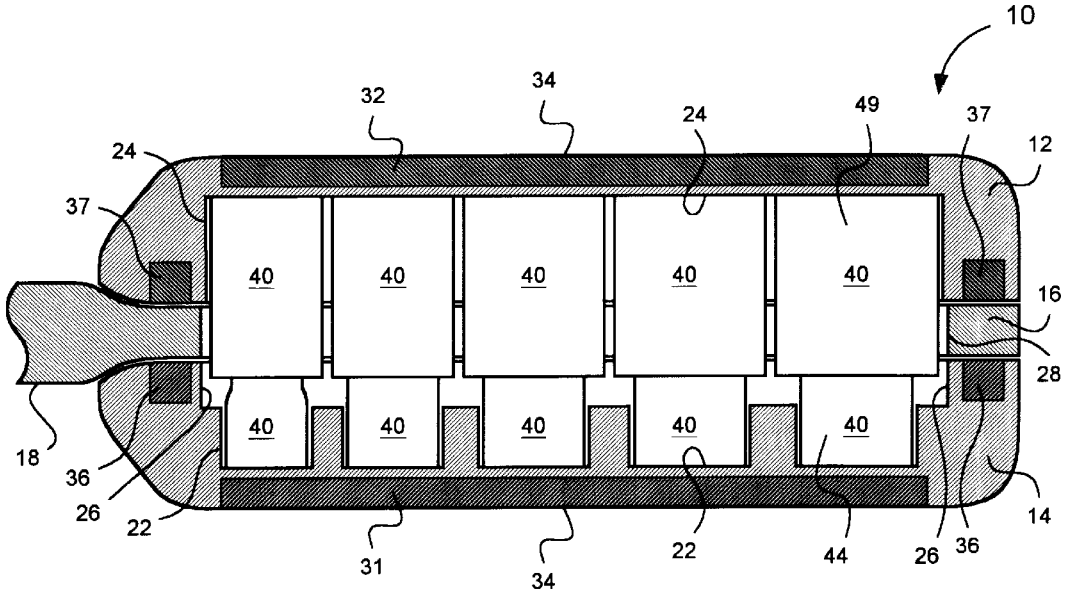
FIG. 2 is a cross sectional view, taken along line 2—2 in FIG. 1, of a socket wrench organizer in accordance with one embodiment of the present invention.

Referring now to FIGS. 1 and 2, an embodiment of socket wrench organizer 10 includes top socket holder 12 and bottom socket holder 14. Socket wrench handle 16 is adapted for assembly to socket wrench organizer 10.

FIG. 1 shows a perspective view of socket wrench organizer 10 in a disassembled state with vertical dashed lines indicating alignment for assembly of socket wrench organizer 10. Assembly of socket wrench organizer 10, after storing sockets in top socket holder 12 and bottom socket holder 14, is accomplished by moving top socket holder 12 and bottom socket holder 14 until they come in contact with the flat portion of handle 16 of socket wrench 18 and are aligned with handle 16 as indicated by the vertical dashed lines in FIG. 1. Disassembly of socket wrench organizer 10, for allowing access to the sockets stored within socket wrench organizer 10, is accomplished by simply separating the pieces top socket holder 12 and bottom socket holder 14 from socket wrench handle 16.

As shown in FIG. 1, bottom socket holder 14 includes receptacles 22 for holding sockets for socket wrench 18. Top socket holder 12 also includes receptacles 24, shown in FIG. 2, for holding sockets for socket wrench 18. The sockets, for example, can be a set of standard metric sized or inch sized sockets using a standard size drive such as ¼, ⅜, or ½ inch square. In the embodiment shown in FIGS. 1 and 2, receptacles 22 and 24 are formed as circular holes in bottom socket holder 14 and top socket holder 12, respectively. The diameter of each of the holes forming receptacles 22 and 24 is just large enough to easily accommodate a corresponding socket from the set of sockets which socket wrench organizer 10 is intended to accommodate. For example, socket wrench organizer 10 can be dimensioned to accommodate a standard set of ⅜ inch drive metric sockets 40 comprising a set of 10 sockets ranging in size from a 19 millimeter ("mm") socket in steps of 1 mm down to a 10 mm socket. Thus, in the example embodiment shown in FIGS. 1 and 2, a first receptacle 22 in bottom socket holder 14 is sized just large enough to easily accommodate the 10 mm socket, a second receptacle 22 is sized just large enough to easily accommodate the 11 mm socket, and so forth up to a fifth receptacle 22 sized just large enough to easily accommodate the 14 mm socket, and then a first receptacle 24 in top socket holder 12 is sized just large enough to easily accommodate the 15 mm socket, a second receptacle 24 is sized just large enough to easily accommodate the 16 mm socket, and so forth up to a fifth receptacle 24 sized just large enough to easily accommodate the 19 mm socket.

As seen in FIG. 2, sockets 40 are held in place in receptacles 22 by magnet 31 and in receptacles 24 by magnet 32. Magnets 31 and 32 can be formed, for example, from flat strips of magnetic material, and preferably are strong enough to support the weight of sockets 40 in contact with magnets 31 and 32 when bottom socket holder 14 or top socket holder 12, respectively, is held upside down. Thus, sockets 40 are prevented from accidentally falling out, possibly becoming lost or inconveniencing the user. Such magnetic strips are commonly available and any sufficiently strong magnetic strip can be used to form magnets 31 and 32. Magnets 31 and 32 can be affixed to bottom socket holder 14 and top socket holder 12, respectively, by bonding, for example, or by appropriately shaping and molding the bottom socket holder 14 and top socket holder 12, which can be fabricated, for example, from injection molded plastic. For example, magnets 31 and 32 can be molded into bottom socket holder 14 and top socket holder 12, as known in the art.

Magnets 31 and 32 perform a dual function in addition to holding sockets 40 in place in their respective socket holder.

Magnets 31 and 32 can also be used to hold the sockets 40 and socket holder 12 or 14 to a magnetizable or magnetically attractable work surface, such as a car fender, metal equipment rack, or computer box. The ability to temporarily attach socket holders 12 and 14 with their sockets 40 to a work surface greatly enhances the convenience of using the socket wrench and helps to keep the sockets organized by allowing easy replacement of unused sockets into their holder while working. Depending on the material out of which socket holders 12 and 14 are made, potential marring or scratching of a painted work surface, such as a car fender, by temporarily attaching socket holder 12 or 14 to it may not be a problem. Nevertheless, socket holders 12 and 14 can be provided with a suitable non-marring coating 34, as indicated in FIG. 2. For example, non-marring coating 34 can be a rubberized coating.

Fasteners 36 hold bottom socket holder 14 to socket wrench handle 16 and fasteners 37 hold top socket holder 12 to socket wrench handle 16 when socket wrench organizer 10 is assembled, also referred to as "closed". In the embodiment shown in the FIGS. 1 and 2, fasteners 36 and 37 are fabricated from magnets which are strong enough to hold the weight of their respective socket holder and sockets. Preferably, when magnets are used for fasteners 36 and 37, the north poles of fasteners 36 are oriented to be closer to the south poles of fasteners 37 (or vice versa) when socket wrench organizer 10 is assembled or closed, so that fasteners 36 in bottom socket holder 14 are attracted toward fasteners 37 in top socket holder 12. As with magnets 31 and 32, fasteners 36 and 37 can be bonded or molded in place. Also, mechanical type fasteners, such as snap fasteners, can be used to effect the function of fasteners 36 and 37.

Thus, fasteners 36 and 37 hold socket wrench organizer 10 together in the assembled or closed position when it is desired to store sockets 40. With socket wrench organizer 10 held closed in its assembled position by fasteners 36 and 37, socket wrench organizer 10 confines sockets 40 in an interior space so that fasteners 36 and 37 enhance the function of magnets 31 and 32 in keeping sockets from accidentally falling out, possibly becoming lost or inconveniencing the user. Furthermore, in the embodiment shown in FIGS. 1 and 2, socket wrench organizer 10 is held closed together with wrench 18 further enhancing the organizing and convenience functions of socket wrench organizer 10. Moreover, with socket wrench organizer 10 in its closed position, magnets 31 and 32 can be used to adhere socket wrench organizer 10 and wrench 18 to a work surface or other desirable location, such as a particular spot or side in the interior of a metal toolbox drawer. As another example, with socket wrench organizer 10 in its closed position magnets 31 and 32 can be used to adhere socket wrench organizer 10 and wrench 18 to another socket wrench organizer for a different drive size wrench, so that two or more socket wrench organizers and wrenches of different drive sizes can be easily kept together or carried together.

As more clearly seen in FIG. 2, sockets 40 are nested within each other when stored in socket wrench organizer 10 in its closed position. In other words, in the example embodiment shown in FIG. 2, 14 mm socket 44 of the set of sockets 40 is stored partially inserted into 19 mm socket 49 of the set of sockets 40, for example, and so on for the other sockets in the set of sockets 40. Nesting of sockets 40 in this manner saves space, allowing socket wrench organizer 10 to be more compact, and thus more space efficient, useful and convenient. Nesting of the sockets stored in bottom socket holder 14 into the sockets stored in top socket holder 12 also serves the function of aligning bottom socket holder 14 with top socket holder 12 using the positioning of the sockets in receptacles 22 and 24. Thus, no alignment pins or holes are needed in socket holders 12 and 14. Nor do fasteners 36 and 37 need to perform any alignment functions, so that forming fasteners 36 and 37 from a pair of magnets mounted flush to the surface of socket holders 12 and 14 is sufficient to hold socket holders 12 and 14 in alignment to each other. Socket wrench handle 16 is provided with a hole or holes 28 which are sized to accommodate the larger size sockets stored in top socket holder 12. Thus, holes 28 also perform a similar alignment function of top socket holder 12 to socket wrench handle 16 using the positioning of the larger sockets in receptacles 24 and the positioning of holes 28 in handle 16. Holes 28 can also perform other useful functions, for example, guarding the user's fingers from sudden impact against nearby objects accompanying the sudden acceleration of the wrench handle when a nut or bolt is "broken loose". Holes 28 can also facilitate working handle 16 of socket wrench 18 back and forth when socket wrench 18 is being used in a tight spot where movement of handle 16 is confined by nearby objects.

In the embodiment shown in FIGS. 1 and 2, the most space efficient nesting of sockets 40, i.e. a nesting which allows minimizing the thickness of both bottom socket holder 14 and top socket holder 12, is a nesting which allows the larger sockets stored in top socket holder 12 to protrude part way through socket wrench handle 16 and into bottom socket holder 14. The smaller receptacles 22 in bottom socket holder 14 are provided with enlarged portions 26 which are sized to accommodate the larger sockets, as shown in FIG. 1, and as shown more clearly in relation to sockets 40 in FIG. 2.

Figure 3:
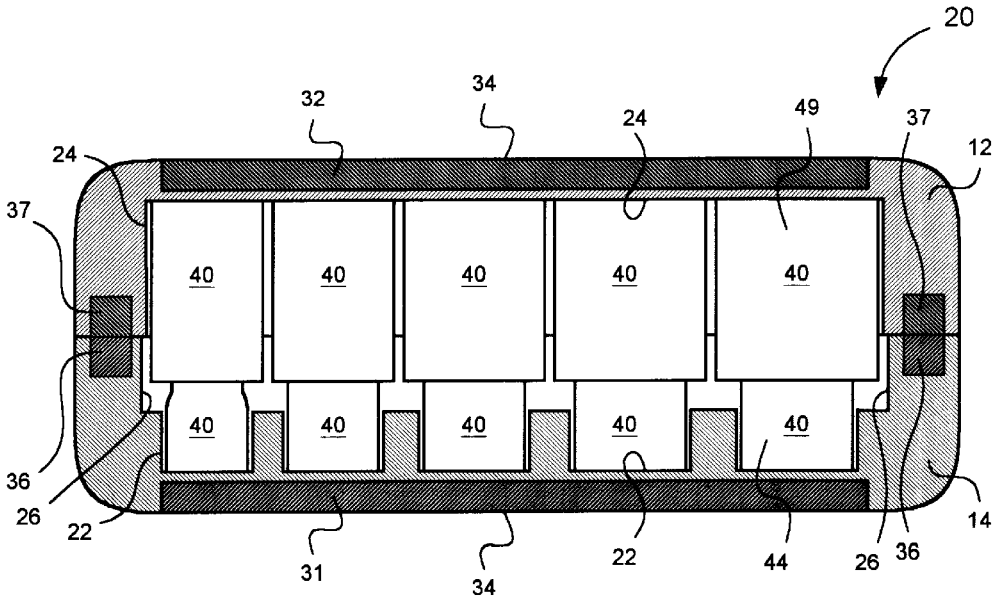
FIG. 3 is a cross sectional view, similar to that of FIG. 2, of a socket wrench organizer in accordance with another embodiment of the present invention.

FIG. 3 shows socket wrench organizer 20. Socket wrench organizer 20 can be used with or without the wrench handle adaptation shown in FIG. 1. As seen in FIG. 3, top socket holder 12 and bottom socket holder 14 of socket wrench organizer 20 are both made thicker than in socket wrench organizer 10. Thus, socket wrench organizer 20 closes completely even though no wrench handle is sandwiched between top socket holder 12 and bottom socket holder 14 of socket wrench organizer 20. Socket wrench organizer 20 can also be used in conjunction with wrench handle 16 shown in FIG. 1, by simply positioning socket wrench organizer 20, shown in FIG. 3, containing sockets 40, against wrench handle 16 in the same manner as socket wrench organizer 10, shown in FIGS. 1 and 2, would be positioned against wrench handle 16.

As seen in FIG. 3, sockets 40 fit into receptacles 22 and 24 of socket wrench organizer 20. Receptacles 22 are provided with enlarged portions 26 to allow for nesting of the sockets 40. Nesting of the sockets 40 can be used to align magnetic fasteners 36 and 37 and to align top socket holder 12 to bottom socket holder 14 in the closed position. Magnetic fasteners 36 and 37 are used for holding top socket holder 12 to bottom socket holder 14 in the closed position for storing sockets 40 more safely. Alternatively, fasteners 36 and 37 can be provided as mechanical fasteners and can be made to align without using nesting of sockets 40.

Socket wrench organizer 20 can also be provided with, for example, a molded contour or clip for attachment to a standard wrench handle (not shown). Such a molded contour or clip can be provided on either one or both of top socket holder 12 and bottom socket holder 14, as would be apparent to a person of ordinary skill in the art. Preferably, such a molded contour or clip can be provided on the side of either one or both of top socket holder 12 and bottom socket holder 14, i.e. away from magnets 31 and 32, so that the contour or clip does not interfere with the function of magnets 31 and 32 in providing temporary attachment to a magnetizable work surface or interfere with top socket holder 12 or bottom socket holder 14 resting stably on a non-magnetizable work surface.

Figure 4:
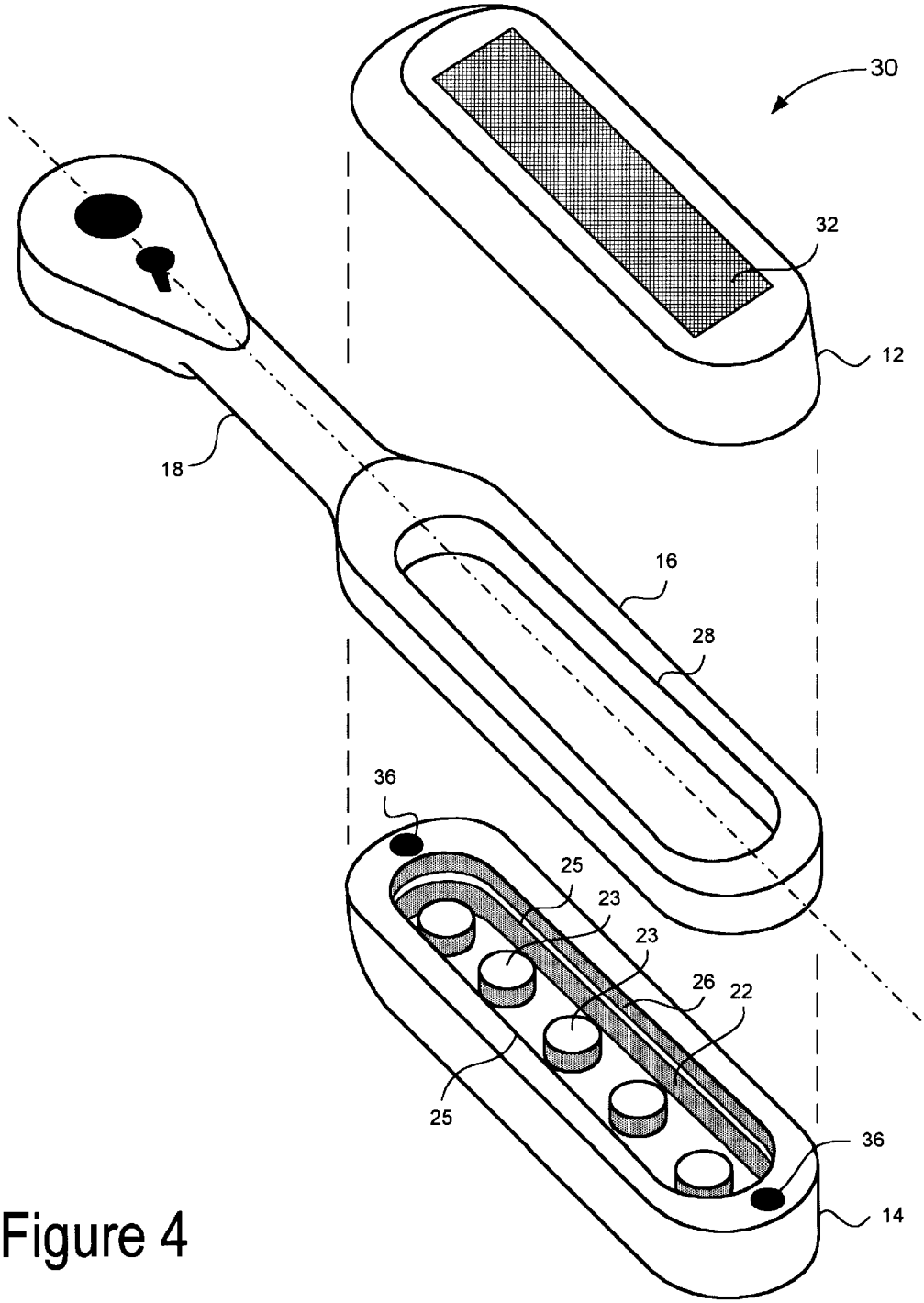
FIG. 4 is a perspective view of a socket wrench organizer in a disassembled state in accordance with one embodiment of the present invention.

FIG. 4 shows one embodiment, socket wrench organizer 30, in which a single receptacle 22 is provided in bottom socket holder 14 and a single receptacle 24 is provided in top socket holder 12. Centering nubs 23 are provided in both top socket holder 12 and bottom socket holder 14 for aligning the set of sockets 40. Centering nubs 23 are all the same size as the drive size of the set of sockets 40, in the present example, ⅜ inch. For example, centering nubs 23 can be made round with the same diameter as the size of the square drive nub. In the present example using ⅜ inch drive sockets 40, centering nubs 23 have ⅜ inch diameter. Centering nubs 23 need not be used for gripping the sockets 40 to hold them in socket holders 12 or 14 as sockets 40 can still be held in socket holders 12 and 14 by magnets 31 and 32. Centering nubs 23 may also be formed from magnetic material to provide additional security for holding sockets 40, or as a substitute for magnets 31 and 32. Thus, centering nubs 23 are substantially not subject to wear, and do not lose their function of aligning and positioning sockets 40 inside top socket holder 12 and bottom socket holder 14 even in the presence of wear. Thus, centering nubs 23 do not encounter the wear problems associated with socket holding nubs or tabs in the prior art, because the function of centering nubs 23 is different from that of the socket holding nubs or tabs in the prior art.

FIG. 4 also shows an alternative means for aligning the set of sockets 40. The sides of receptacles 22 and 24 are provided with a linear taper 25 in size from the end sized to accommodate the largest socket to the end sized to accommodate the smallest socket. When receptacles 22 and 24 are linearly tapered in size from one end to the other in this fashion, the sockets may simply be arranged in order of decreasing size from one end to the other within receptacles 22 and 24 without the use of centering nubs 23. In other words, it is desirable for centering nubs 23 to be absent when tapered receptacles are used. When receptacles 22 and 24 are linearly tapered in size, it is desirable to similarly taper hole 28 in wrench handle 16 when using hole 28 to perform the function of aligning top socket holder 12 to socket wrench handle 16 using the positioning of the larger sockets in receptacle 24 and the positioning of hole 28 in handle 16, as further described below.

As seen in FIG. 4, sockets 40 fit into receptacles 22 and 24. Receptacle 22 can be provided with an enlarged portion 26 to allow for nesting of the set of sockets 40. When centering nubs 23 are used to align sockets 40, however, receptacle 22 can simply be made larger in order to allow nesting of the set of sockets 40. Nesting of the set of sockets 40 can be used to align magnetic fasteners 36 and 37 and to align top socket holder 12 to bottom socket holder 14 in the closed position. Magnetic fasteners 36 and 37 are used for holding top socket holder 12 to bottom socket holder 14 in the closed position for storing sockets 40 more safely. Alternatively, fasteners 36 and 37 can be provided as mechanical fasteners and can be made to align without using nesting of sockets 40. When nesting of sockets 40 is used to align top socket holder 12 to bottom socket holder 14, hole 28 in wrench handle 16 should be dimensioned to accommodate the larger size sockets stored in top socket holder 12 so that hole 28 also performs the function of aligning top socket holder 12 to socket wrench handle 16 using the positioning of the larger sockets in receptacle 24 and the positioning of hole 28 in handle 16.

Socket wrench organizer 30, shown in FIG. 4, has certain advantages of simplicity in that, for example, there is only one receptacle 22 and only one receptacle 24. Furthermore, the receptacles 22 and 24 do not need to be closely or individually sized to the set of sockets 40 because centering nubs 23 perform the function of positioning or aligning the sockets 40 within socket holders 12 and 14. In addition, all of the centering nubs 23 are the same size, being the same size as the drive size for the set of sockets 40 and socket wrench being used.

As seen in the above detailed description, the present invention provides an improved socket wrench organizer that solves several of the problems associated with conventional socket holders.

The socket wrench organizer of the present invention securely holds a number of interchangeable sockets, using magnets, in a way which is not affected by normal wear and which protects the sockets from being accidentally dislodged or removed while the sockets are being stored or carried. In one embodiment, the socket wrench organizer can be conveniently placed on or temporarily attached to a work surface without marring or scratching the work surface. The socket wrench organizer of the present invention is compact and space efficient, which facilitates storing sockets, for example, in crowded toolboxes. The same magnets which are useful for temporarily attaching the socket wrench organizer to a work surface can also be used, for example, to "stick" the socket wrench organizer to a certain spot in a metal toolbox drawer. Further, the same magnets which are useful for temporarily attaching the socket wrench organizer to a work surface can also be used, for example, to "stick" two or more socket wrench organizers together so that different size wrenches, i.e. different drive sizes, and socket sets can be more easily kept together. In one embodiment, a wrench handle is shown which can provide additional useful functions, such as a protecting the user's hands from impact. More importantly, the present invention provides a socket wrench organizer that facilitates keeping the sockets together with the wrench with which they are to be used, substantially enhancing its usefulness and organizing value over conventional socket holders which do not provide that function.

As the above detailed description suggests, a number of modifications can be made and a variety of techniques can be used to implement the concepts of the present invention. While the invention has been described with specific reference to certain embodiments, a person of ordinary skill in the art would recognize that changes can be made in form and detail without departing from the spirit and scope of the invention.

Thus, it should be understood that the invention is not limited to the particular embodiments described here, and that modifications may be made without departing from the spirit and scope of the invention as set forth in the following claims.

What is claimed is:

1. A wrench having a socket organizer for holding a set of sockets that includes a first plurality of sockets and a second plurality of sockets, said wrench comprising:

a wrench handle having a top flat portion, a bottom flat portion, and a hole sized to accommodate said first plurality of sockets from said set of sockets;

a top socket holder having a first receptacle, said first receptacle sized to accommodate said first plurality of sockets from said set of sockets, wherein said top socket holder contacts said top flat portion and said first receptacle aligns with said hole when said wrench handle and said top socket holder are assembled, and said top socket holder having a first magnet for holding said first plurality of sockets in said first receptacle;

a bottom socket holder having a second receptacle, said second receptacle sized to accommodate said second plurality of sockets from said set of sockets, wherein said bottom socket holder contacts said bottom flat portion and said second receptacle aligns with said hole when said wrench handle and said bottom socket holder are assembled, and said bottom socket holder having a second magnet for holding said second plurality of sockets in said second receptacle;

a plurality of fasteners for holding said wrench having a socket organizer in a closed position, wherein said wrench handle and said top socket holder are assembled, said wrench handle and said bottom socket holder are assembled, and said first receptacle and said second receptacle align with said hole to form an interior space for confining both said first plurality of sockets and said second plurality of sockets.

2. The wrench of claim 1, wherein said bottom socket holder is adapted to hold each of said second plurality of sockets from said set of sockets nested inside a corresponding socket of said first plurality of sockets from said set of sockets when said wrench is in said closed position, wherein said top socket holder is adapted to hold said first plurality of sockets.

3. The wrench of claim 1, further comprising centering nubs in said first receptacle adapted for aligning said first plurality of sockets.

4. The wrench of claim 1, further comprising centering nubs in said second receptacle adapted for aligning said second plurality of sockets.

5. The socket wrench organizer of claim 1, wherein said first receptacle has linearly tapered sides adapted for aligning said first plurality of sockets.

6. The socket wrench organizer of claim 1, wherein said second receptacle has linearly tapered sides adapted for aligning said second plurality of sockets.

7. The wrench of claim 1, wherein said second receptacle has an enlarged portion sized to accommodate said first plurality of sockets.

8. The wrench of claim 1, wherein a plurality of top fasteners in said plurality of fasteners holds said top socket holder to said wrench handle.

9. The wrench of claim 1, wherein a plurality of bottom fasteners in said plurality of fasteners holds said bottom socket holder to said wrench handle.

10. The wrench of claim 1, wherein each fastener in said plurality of fasteners is a magnet.

11. The wrench of claim 1, wherein said first magnet is capable of providing temporary attachment of said first socket holder to a magnetically attractable work surface.

12. The wrench of claim 1, wherein said second magnet is capable of providing temporary attachment of said second socket holder to a magnetically attractable work surface.

13. The wrench of claim 1, wherein said top and bottom socket holders have a rubberized coating.

14. The wrench of claim 3, wherein said centering nubs comprise magnetic material.

15. The wrench of claim 4, wherein said centering nubs comprise magnetic material.

16. A wrench having a socket organizer, comprising:

a wrench handle having a top flat portion, a bottom flat portion, and a hole through said wrench handle between said top flat portion and said bottom flat portion and sized to accommodate sockets;

a top socket holder having a first receptacle with a first opening sized to match said hole, wherein said top socket holder contacts said top flat portion of said wrench handle and said first receptacle aligns with said hole when said wrench handle and said top socket holder are assembled;

at least one first magnet in said top socket holder;

a bottom socket holder having a second receptacle with a second opening sized to match said hole, wherein said bottom socket holder contacts said bottom flat portion of said wrench handle and said second receptacle aligns with said hole when said wrench handle and said bottom socket holder are assembled;

at least one second magnet in said bottom socket holder;

a first plurality of fasteners that holds said top socket holder to said wrench handle when said wrench handle and said top socket holder are assembled;

a second plurality of fasteners that holds said bottom socket holder to said wrench handle when said wrench handle and said bottom socket holder are assembled, wherein:

when said wrench handle and said top socket holder are assembled, and said wrench handle and said bottom socket holder are assembled, said first receptacle and said second receptacle and said hole form an interior space wherein said first receptacle and said second receptacle are vertically aligned.

17. The wrench having a socket organizer of claim 16, further comprising:

a first plurality of sockets stored in said first receptacle;

a second plurality of sockets stored in said second receptacle, wherein:

each socket of said second plurality of sockets is nested inside a corresponding socket of said first plurality of sockets when said wrench handle and said top socket holder are assembled and said wrench handle and said bottom socket holder are assembled.

18. The wrench having a socket organizer of claim 17, further comprising:

a first plurality of centering nubs in said first receptacle, wherein each centering nub of said first plurality. of centering nubs comprises magnetic material and holds one socket of said first plurality of sockets; and a second plurality of centering nubs in said second receptacle, wherein each centering nub of said second plurality of centering nubs comprises magnetic material and holds one socket of said second plurality of sockets.

19. The wrench having a socket organizer of claim 16, further comprising a first plurality of centering nubs in said first receptacle.

20. The wrench having a socket organizer of claim 16, further comprising a second plurality of centering nubs in said second receptacle.

21. The wrench having a socket organizer of claim 16, wherein said at least one first magnet is a centering nub and said at least one second magnet is a centering nub.

* * * * *